US009495896B2

(12) United States Patent
Liu

(10) Patent No.: US 9,495,896 B2
(45) Date of Patent: Nov. 15, 2016

(54) LIQUID CRYSTAL DISPLAY APPARATUS WITH BRIGHTNESS/LUMINANCE HOLDING RATIO COMPENSATION AND A DRIVING METHOD THEREOF

(76) Inventor: Hung-Ta Liu, Zhubei (TW)

( * ) Notice: Subject to any disclaimer, the term of this patent is extended or adjusted under 35 U.S.C. 154(b) by 0 days.

(21) Appl. No.: 13/348,580

(22) Filed: Jan. 11, 2012

(65) Prior Publication Data

US 2012/0182332 A1 Jul. 19, 2012

(30) Foreign Application Priority Data

Jan. 17, 2011 (TW) ..... 100101659 A

(51) Int. Cl.

*G09G 3/36* (2006.01)
*G09G 3/20* (2006.01)
*G09G 3/34* (2006.01)

(52) U.S. Cl.

CPC ..... *G09G 3/2007* (2013.01); *G09G 3/3406* (2013.01); *G09G 2310/0237* (2013.01); *G09G 2320/064* (2013.01); *G09G 2330/021* (2013.01)

(58) Field of Classification Search

CPC ..... G09G 3/3406; G09G 232/064; G09G 2310/0237
USPC ..... 345/102
See application file for complete search history.

(56) References Cited

U.S. PATENT DOCUMENTS 5,844,540 A * 12/1998 Terasaki ..... 345/102
6,219,019 B1 * 4/2001 Hasegawa et al. ..... 345/96
6,804,037 B1 * 10/2004 Nito et al. ..... 359/253
7,733,322 B2 * 6/2010 Araki et al. ..... 345/100
8,395,602 B2 * 3/2013 Akiyama et al. ..... 345/204
2008/0180385 A1 * 7/2008 Yoshida et al. ..... 345/102
2009/0122087 A1 * 5/2009 Maruyama et al. ..... 345/690
2009/0315471 A1 * 12/2009 Rowland ..... 315/224
2010/0066754 A1 * 3/2010 Kuroda ..... 345/589
2011/0181197 A1 * 7/2011 Kanda et al. ..... 315/268
2011/0267383 A1 * 11/2011 Murakami et al. ..... 345/690
2011/0298834 A1 * 12/2011 Shin ..... G09G 3/3406 345/690
2013/0257707 A1 * 10/2013 Matsumura ..... H05B 33/0833 345/102

FOREIGN PATENT DOCUMENTS

CN 1400488 A 3/2003
CN 101053008 A 10/2007
CN 101414438 A 4/2009
CN 101053008 5/2010
CN 101772438 7/2010
JP 2003255914 A 9/2003
JP WO2010/134235 A1 * 11/2010 ..... G09G 3/36
TW 200941437 10/2009
TW 201037656 10/2010

* cited by examiner

*Primary Examiner* — Chanh Nguyen
*Assistant Examiner* — Yuzhen Shen
(74) *Attorney, Agent, or Firm* — Jonathan A. Kidney; TechLaw LLP

(57) ABSTRACT

The invention discloses a liquid crystal display (LCD) apparatus and a brightness/luminance holding ratio compensation method. A backlight module of the LCD apparatus may form a plurality of backlight shield-blocking periods in a display frame cycle or adjust output brightness gradually, for compensating a brightness/luminance bias caused by a transmittance variance of liquid crystal cell in the low refresh rate driving LCD apparatus, so as to avoid some abnormal display effects, such as screen flicker. Besides, the LCD apparatus has better energy efficiency by utilizing a low-voltage gray level driving method or saving the power consumption of the backlight module.

21 Claims, 11 Drawing Sheets

LIQUID CRYSTAL DISPLAY APPARATUS WITH BRIGHTNESS/LUMINANCE HOLDING RATIO COMPENSATION AND A DRIVING METHOD THEREOF

RELATED APPLICATIONS

This application claims the benefit of and priority to Taiwan Application Serial Number 100101659, filed Jan. 17, 2011, which is herein incorporated by reference in its entirety.

BACKGROUND

Field of Invention

The invention relates to a liquid crystal display (LCD) apparatus. More particularly, the invention relates to an LCD apparatus with brightness/luminance holding ratio compensation and a driving method thereof.

Description of Related Art

In recent years, a liquid crystal display (LCD) apparatus has been applied in many areas, including a notebook personal computer, a monitor, a vehicular navigation device, a functional calculator, various sizes of TV sets, a mobile phone and an electronic message board. Particularly, the current thin and light or portable electronic products have become a new trend in the market. The LCD apparatus has a smaller volume and thickness than the prior CRT (cathode-ray tube) display apparatus, so the LCD apparatus has been widely applied.

In the development of the current electronic display technology, the power consumption of the display apparatus is emphasized, so the LCD apparatus with low power consumption better meets the requirements of a user for energy saving and environment protection. Particularly, in a portable display apparatus (such as a cellular phone, a smart phone, a PDA (personal digital assistant), an e-book and a tablet computer), the power consumption of the LCD module directly influences the endurance of the entire apparatus. Particularly, in the current large-size, thin and light display apparatus, the LCD module with the low power consumption and high efficiency is urgently demanded.

The current LCD apparatus generally has a certain refresh rate or frame rate. Generally, the LCD apparatus adopts the rate of 50-70 Hz. That is, the frame refreshes 50-70 times per second.

In other words, even if the display frame of the LCD apparatus has no change or few changes, the display driving circuit may still periodically refresh a display signal of each pixel of the display module at the rate of 60 times per second. Thus, unnecessary energy consumption is generated.

For a current general TFT-LCD (thin film transistor liquid crystal display) apparatus on the market, the power consumption is mainly caused by the LCD panel, the driving circuit and the backlight module. Taking the 10.1-inch TFT-LCD apparatus with a resolution of 1366×800 as an example, the power consumption of the LCD panel and the driving circuit is approximately between 1000 mW and 2000 mW. On the other hand, the power consumption of the backlight module is approximately between 2000 mW and 3000 mW.

Although a polarity inversion driving manner, e.g. a row inversion driving manner or a frame inversion driving manner, has been proposed in this industry directed for the driving circuit, and an area scanning backlight manner has been proposed directed for the backlight module, the above manners have limited effects. Therefore, those in the industry are endeavoring to find an LCD apparatus having a stable display effect and low energy consumption and a display driving method thereof.

In a display frame cycle between two display signal refreshes, the potential levels of the storage capacitance in the LCD apparatus may gradually decrease over time, resulting in the transmittance variance of the LCD panel. For example, in a normally white mode, the transmittance increases over time, and in a normally black mode, the transmittance decreases over time, thus probably resulting in the inconsistent or unstable display brightness/luminance in a display frame cycle and further causing the blink and screen flicker phenomena. Particularly, at the low refresh rate, the potential-levels attenuation degree of the storage capacitance is more apparent, and consequently, the problem of screen flicker is severe.

SUMMARY

To solve the above problems, the invention discloses a liquid crystal display (LCD) apparatus having a better power saving effect by utilizing a gray level curve characteristic and an LCD apparatus with brightness/luminance holding ratio compensation.

In a display frame cycle between two display signal refreshes, particularly for a low refresh rate driving LCD apparatus, the potential levels of a storage capacitance in a general LCD apparatus may gradually change over time, resulting in the transmittance variance of the LCD panel and further causing the blink and screen flicker phenomena. The invention provides an LCD apparatus with brightness/luminance holding ratio compensation. For example, in a display frame cycle, a driving configuration of a backlight module is gradiently adjusted. Moreover, in the invention, a gray level curve characteristic of the driving voltage versus the gray levels brightness of the LCD panel is used for driving with a lower driving voltage, so as to reduce the power consumption and perform the brightness/luminance holding ratio compensation at a low refresh rate.

An aspect of the invention provides an LCD apparatus with brightness/luminance holding ratio compensation, which includes an LCD panel, a driving circuit and a backlight module. In a display frame cycle, a transmittance or brightness/luminance of the LCD panel increases over time. The driving circuit drives the LCD panel according to a driving voltage. The backlight module includes a backlight source, a backlight driving circuit and a backlight control circuit. The backlight driving circuit is used for driving the backlight source. The backlight control circuit forms a plurality of backlight shield-blocking periods in the display frame cycle, and the backlight control circuit controls the backlight driving circuit to temporarily turn off or turn dark the backlight source or temporarily turn down the backlight source to a dark state (a dim state which is not completely black) in the backlight shield-blocking periods.

According to an embodiment of the invention, the driving circuit drives the LCD panel at a low refresh rate.

According to another embodiment of the invention, the LCD panel is a normally white mode LCD panel. In this embodiment, in the display frame cycle, a shield-blocking persistent period of the backlight shield-blocking periods sequentially increases.

According to yet another embodiment of the invention, the LCD panel is a normally black mode LCD panel. In this embodiment, in the display frame cycle, the shield-blocking persistent period of the backlight shield-blocking periods sequentially decreases.

According to still another embodiment of the invention, the display frame cycle is divided into N cycle intervals. The backlight control circuit forms at least one backlight shield-blocking period in each cycle interval, thus totally forming at least N backlight shield-blocking periods. That is, the backlight source forms at least N shield-blocking periods, during which the backlight control circuit controls the backlight driving circuit to temporarily turn off or turn dark the backlight source or temporarily turn down the backlight source to a dark state.

According to still yet another embodiment of the invention, the display frame cycle is divided into N cycle intervals, and the difference of an optical integration of the transmittance or brightness/luminance of the LCD apparatus to time for each cycle interval is less than or equal to 5%.

According to an embodiment of the invention, the display frame cycle is divided into N cycle intervals. The backlight control circuit forms a first backlight shield-blocking period at the start of the first cycle interval, or forms a second backlight shield-blocking period at the end of the Nth cycle interval, and forms at least one backlight shield-blocking period in each of other cycle intervals, thus totally forming at least N backlight shield-blocking periods. The first backlight shield-blocking period and the second backlight shield-blocking period correspond to a liquid crystal switching speed of the LCD panel, thereby improving a switching response speed of the LCD panel.

According to another embodiment of the invention, the backlight function. module has backlight driving architecture with an area scanning backlight According to yet another embodiment of the invention, the refresh rate is lower than 20 Hz. In another embodiment, the low refresh rate is lower than 5 Hz.

According to still another embodiment of the invention, the LCD panel has two or more refresh rates.

Another aspect of the invention also provides an LCD apparatus with brightness/luminance holding ratio compensation, which includes an LCD panel, a driving circuit and a backlight module. In a display frame cycle, a transmittance or brightness/luminance of the LCD panel increases or decreases over time. The driving circuit drives the LCD panel according to a driving voltage. The backlight module includes a backlight source, a backlight driving circuit and a backlight control circuit. The backlight driving circuit provides a backlight driving current for driving the backlight source. In the display frame cycle, the backlight control circuit controls the backlight driving circuit to gradually or gradiently adjust the backlight driving current, so as to make the brightness/luminance of the backlight source change over time.

According to an embodiment of the invention, the driving circuit drives the LCD panel at a low refresh rate.

According to another embodiment of the invention, the LCD panel is a normally white mode LCD panel. In this embodiment, in the display frame cycle, the backlight control circuit controls the backlight driving circuit to gradually or gradiently decrease the backlight driving current, so as to make the brightness/luminance of the backlight source decrease over time.

In the above embodiments, a variation curve of a transmittance or brightness/luminance versus a liquid crystal driving voltage of the LCD panel is divided into a plurality of gray levels intervals. Each of the gray levels intervals corresponds to a compensation coefficient of the backlight control circuit. During each gray levels interval, the backlight control circuit controls the backlight driving circuit to gradually or gradiently decrease the backlight driving current according to the compensation coefficient, so as to make the brightness/luminance of the backlight source decrease over time.

According to yet another embodiment of the invention, the display frame cycle is divided into N cycle intervals, and in each cycle interval, the backlight control circuit controls the backlight driving circuit to gradually or gradiently decrease the backlight driving current, so as to make the brightness/luminance of the backlight source decrease along with different cycle intervals.

According to still another embodiment of the invention, the display frame cycle is divided into N cycle intervals, and the difference of an optical integration of the transmittance or brightness/luminance of the LCD apparatus to time for each cycle interval is less than or equal to 5%.

According to still yet another embodiment of the invention, the LCD panel is a normally black mode LCD panel. In this embodiment, in the display frame cycle, the backlight control circuit controls the backlight driving circuit to gradually or gradiently increase the backlight driving current, so as to make the brightness/luminance of the backlight source increase over time.

In the above embodiments, the variation curve of the transmittance or brightness/luminance versus the liquid crystal driving voltage of the LCD panel is divided into a plurality of gray level intervals. Each of the gray level intervals corresponds to a compensation coefficient of the backlight control circuit. During each gray level interval, the backlight control circuit controls the backlight driving circuit to gradually or gradiently increase the backlight driving current according to the compensation coefficient, so as to make the brightness/luminance of the backlight source increase over time.

In the above embodiments, the display frame cycle is divided into N cycle intervals, and in each cycle interval, the backlight control circuit controls the backlight driving circuit to gradually or gradiently increase the backlight driving current, so as to make the brightness/luminance of the backlight source increase along with different cycle intervals.

In the above embodiments, the display frame cycle is divided into N cycle intervals, and the difference of an optical integration of the transmittance or brightness/luminance of the LCD apparatus to time for each cycle interval is less than or equal to 5%.

According to another embodiment of the invention, the backlight module has the backlight driving architecture with an area scanning backlight function.

According to yet another embodiment of the invention, the refresh rate is lower than 20 Hz. In another embodiment, the low refresh rate is lower than 5 Hz.

According to still another embodiment of the invention, the LCD panel has two or more refresh rates.

Yet another aspect of the invention also provides an LCD apparatus having a better power saving effect by utilizing a gray level curve characteristic to perform a gray level display driving conversion. The LCD apparatus has a transmissive or partial-transmissive and partial-reflective (or referred to as transflective) normally white mode LCD panel. In the LCD panel of the LCD apparatus, when a gray level display configuration has a low brightness/luminance gray level, i.e., when the gray level display configuration has a high driving voltage (at the low transmittance), the backlight module may be set at a full bright state with high brightness/luminance for the high backlight driving current. At this time, the invention calculates and determines the data content of a display image, and then automatically converts the low brightness/luminance gray level of the gray levels display configuration to a lower driving voltage (high transmittance) for the LCD panel correspondingly. The backlight module is automatically set to have a low backlight driving current (low brightness/luminance) correspondingly. Thus, the power consumption of the LCD panel is greatly reduced, since "the high driving voltage" of the gray levels display configuration is changed to "the low driving voltage" and the power consumption is in direct proportion to a square of voltage (Power=$V^2$/R). Meanwhile, the power consumption of the backlight module may also be greatly reduced, since the backlight driving current is decreased to the low backlight driving current and the power consumption is in direct proportion to a square of current (Power=R*$I^2$). In this regard, the gray levels display driving is converted into another gray levels display driving with the low power consumption, thereby achieving the power saving effect without changing the overall display brightness/luminance.

According to another embodiment of the invention, the backlight module has a backlight driving architecture with an area scanning backlight function. The display driving conversion reference table may be set according to the display image content of each area. After calculating and determining, the low brightness gray levels of the gray levels display configuration of each area is respectively and automatically converted into a lower driving voltage correspondingly. The backlight module automatically sets a low backlight driving current serving as a compensation levels corresponding to each area respectively. The image data of the display content of each area determines the levels of the lower driving voltage and the compensation levels of the low backlight driving current of the area. Thus, the gray levels display driving of each area is converted into another gray levels display driving with low power consumption.

According to yet another embodiment of the invention, a gray level display driving conversion reference table is set according to various possible displayed image contents, i.e., a conversion reference table regarding the correspondence between the gray levels display driving and a compensation levels of the low backlight driving current. A correspondence relationship is established between the gray level display driving, the gray level display driving level of the lower voltage and low power consumption, and the compensation level of the low backlight driving current. When the backlight module has backlight driving architecture with an area scanning backlight function, the gray level display driving conversion reference table may also correspond to each area respectively. Hence, the power saving effect is achieved without changing the overall display brightness/luminance.

According to an embodiment of the invention, an LCD apparatus having a low refresh rate is further provided. In the display frame cycle, the control unit controls the driving circuit and the backlight driving circuit, thus decreasing the driving voltage by the driving circuit so as to increase the transmittance, and forming a plurality of backlight shield-blocking periods. In the backlight shield-blocking periods, the backlight control circuit controls the backlight driving circuit to temporarily turn off or turn dark the backlight source or temporarily turn down the backlight source to a dark or dim state. A backlight shield-blocking persistent period of the backlight shield-blocking periods sequentially increases, so as to decrease the backlight brightness/luminance.

According to another embodiment of the invention, the low refresh rate is lower than 20 Hz. In another embodiment, the low refresh rate is lower than 5 Hz.

According to yet another embodiment of the invention, the LCD panel has two or more refresh rates.

According to still another embodiment of the invention, an LCD apparatus having a low refresh rate is further provided. In the display frame cycle, the control unit controls the driving circuit and the backlight driving circuit, thus decreasing the driving voltage by the driving circuit so as to increase the transmittance, and decreasing the level of the backlight driving current or the backlight brightness/luminance level of the backlight module by the backlight driving circuit. Meanwhile, in the display frame cycle, the backlight control circuit controls the backlight driving circuit to gradually or gradiently decrease the backlight driving current, so as to make the brightness/luminance of the backlight source decrease over time.

According to an embodiment of the invention, the low refresh rate is lower than 20 Hz. In another embodiment, the low refresh rate is lower than 5 Hz.

According to another embodiment of the invention, the LCD panel has two or more refresh rates.

BRIEF DESCRIPTION OF THE DRAWINGS

In order to make the foregoing as well as other aspects, features, advantages, and embodiments of the invention more apparent, the accompanying drawings are described as follows.

DETAILED DESCRIPTION

Figure 1:
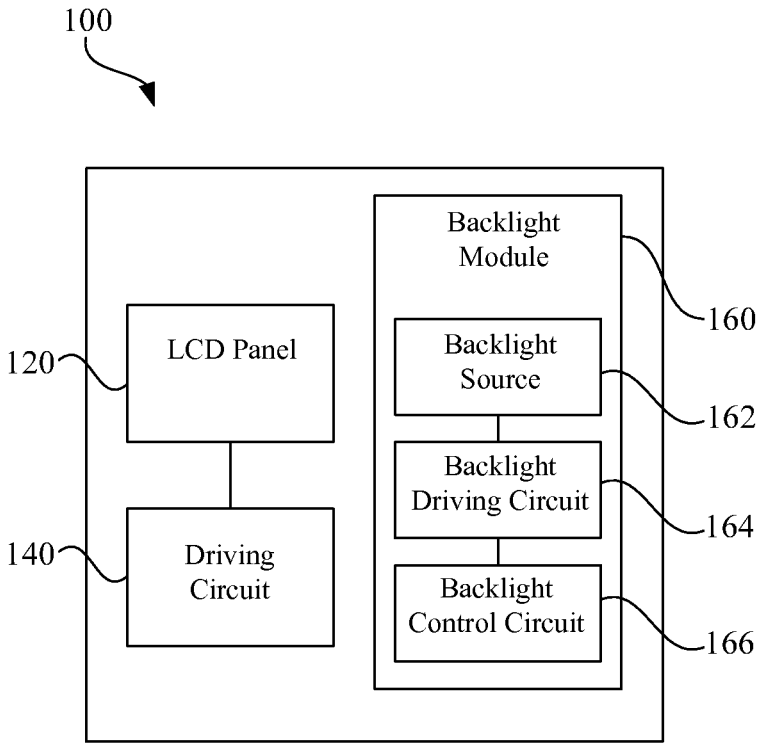
FIG. 1 illustrates a function block diagram of an LCD apparatus with brightness/luminance holding ratio compensation according to a first embodiment of the invention.

Referring to FIG. 1, FIG. 1 illustrates a function block diagram of a liquid crystal display (LCD) apparatus 100 with brightness/luminance holding ratio compensation according to a first embodiment of the invention.

As shown in FIG. 1, the LCD apparatus 100 includes an LCD panel 120, a driving circuit 140 and a backlight module 160. The backlight module 160 includes a backlight source 162, a backlight driving circuit 164 and a backlight control circuit 166.

In an embodiment, the LCD panel 120 may be a transmissive or transflective LCD panel. Referring to FIG. 1, FIG. 1 is a schematic cross-sectional structural view of the LCD panel 120 in the first embodiment.

The LCD panel 120 has a refresh rate and a transmittance. The driving circuit 140 drives the LCD panel 120 according to the driving voltage. The transmittance of the LCD panel 120 is related to the driving voltage.

Figure 2A:
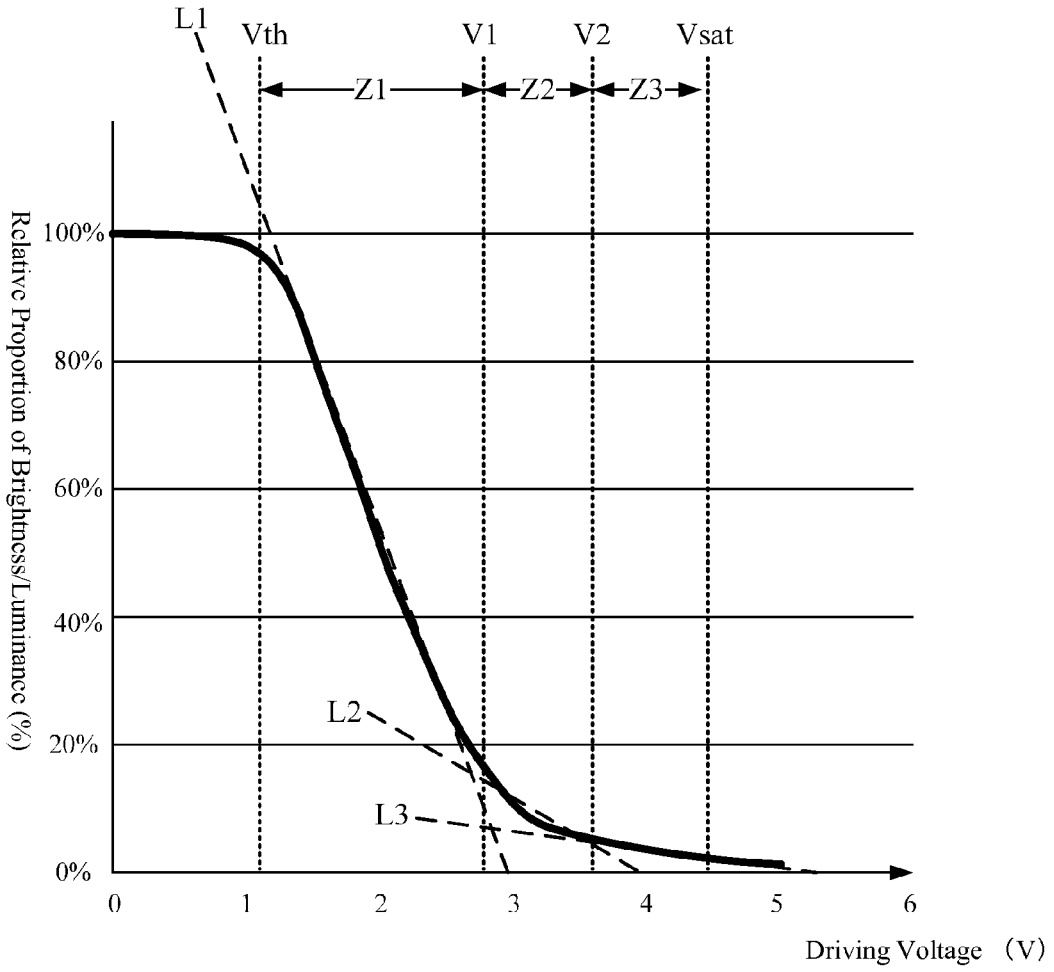
FIG. 2A illustrates a curve diagram of a driving voltage versus relative brightness/luminance of a normally white mode LCD panel.
Figure 2B:
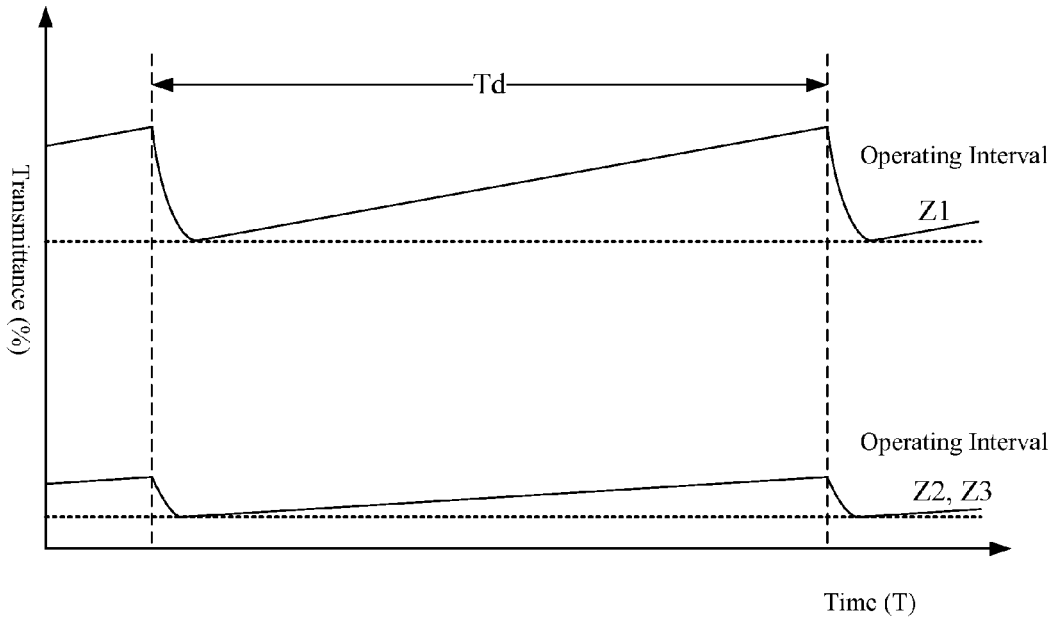
FIG. 2B illustrates a curve diagram of a transmittance of a driving voltage changing over time in different operating intervals of the normally white mode LCD panel.
Figure 3:
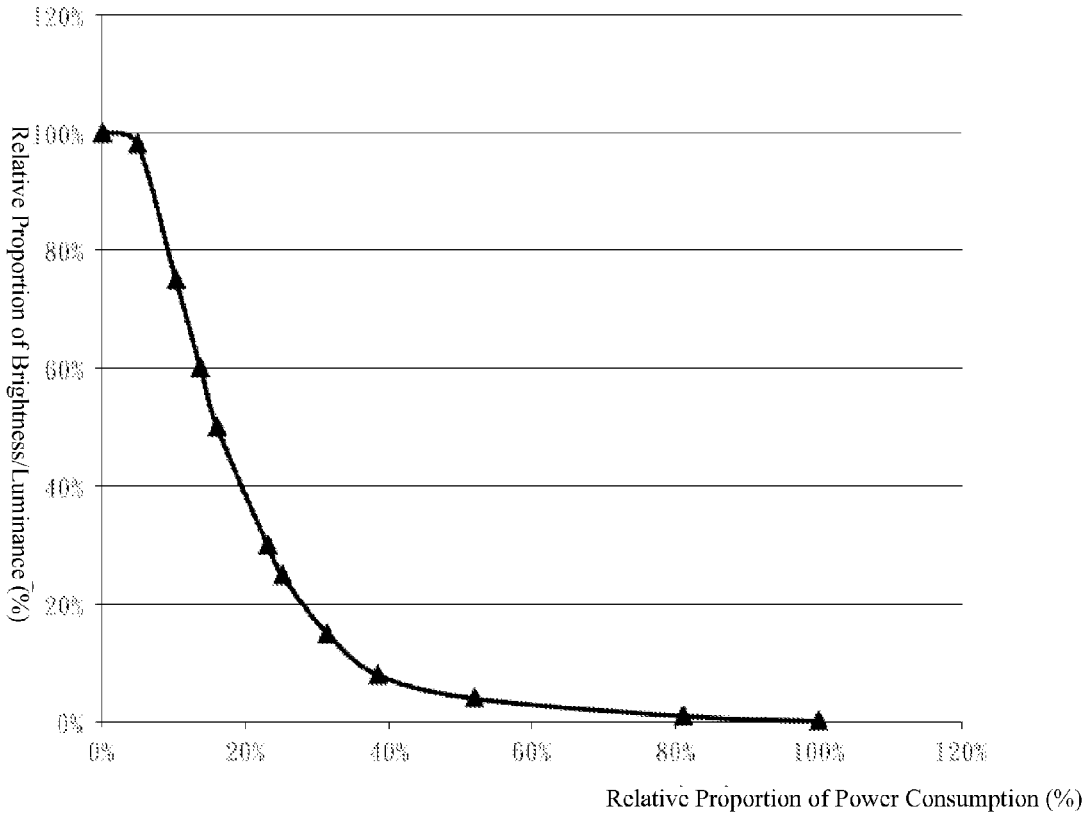
FIG. 3 illustrates a curve diagram of relative power consumption versus the relative brightness/luminance of the normally white mode LCD panel, i.e. a curve diagram of the relative power consumption versus the gray level.

Hereinafter, the LCD panel 120 is for example a normally white mode LCD panel. Referring to FIGS. 2 and 3 together, FIG. 2A illustrates a curve diagram of a driving voltage versus relative brightness/luminance of the normally white mode LCD panel 120. FIG. 3 illustrates a curve diagram of relative power consumption versus relative brightness/luminance of the normally white mode LCD panel 120, i.e. a curve diagram of the relative power consumption versus the display gray level. As shown in FIGS. 2A and 3, when the driving voltage on the normally white mode LCD panel 120 is the low voltage, the normally white mode liquid crystal layer has a high transmittance, i.e. has a high brightness/luminance. As shown in FIG. 3, the power consumption is low. Accordingly, when the driving voltage is high, the normally white mode liquid crystal layer rotates and twists to decrease the transmittance of the LCD panel 120, thus having the low brightness/luminance. As shown in FIG. 3, the power consumption is high at this time.

As shown in FIG. 2A, the gray level curve in FIG. 2A may be divided into several operating intervals (e.g. operating intervals Z1, Z2 and Z3). The brightness/luminance-voltage curve (i.e., the gray level curve in FIG. 2A) may have several linear slopes and includes several operating intervals Z1, Z2 and Z3. A majority of the gray level is concentrated in the operating interval Z1. That is, the driving voltage is the threshold voltages Vth-V1. The operating interval Z2 has a small range, i.e. the driving voltages V1-V2, and the brightness of the operating interval Z2 is lower than 10%. The brightness of the operating interval Z3 is lower than 5%, i.e. the driving voltages V2-Vsat (saturation voltage). Definitely, the gray level curve may also be divided into more gray level intervals or operating intervals.

However, in a display frame cycle, since the driving circuit 140 does not have a voltage holding ratio of 100% (for example, because of a non-ideal factor like attenuation of a storage capacitance), the driving voltage gradually decreases over time. Particularly, when the refresh rate of the LCD panel 120 is low (such as 20 Hz, 3 Hz or even 0.5 Hz), the change of the driving voltage is more apparent. Referring to FIG. 2B, FIG. 2B illustrates a curve diagram of a transmittance of a driving voltage changing over time in different operating intervals of the normally white mode LCD panel 120. As shown in FIG. 2B, in a display frame cycle, the voltage holding ratio of the LCD panel changes by 5%-15%, and the transmittance of the LCD panel changes by 5%-15% accordingly. In the operating interval Z1, the main operating value of the transmittance range changes greatly. In the operating intervals Z2 and Z3, the main operating value of the transmittance range changes slightly and may correspond to different compensation coefficients.

In the normally white mode LCD panel 120, when the driving voltage is attenuated, the transmittance of the LCD panel 120 increases over time. That is, the brightness/luminance of the LCD apparatus increases accordingly. Hence, in this display frame cycle, the display frame of a conventional LCD panel may gradually become bright, thus causing the screen flicker phenomenon.

It should be noted that the LCD panel 120 of the invention may perform the brightness/luminance holding ratio compensation by utilizing the backlight module 160, thereby solving the above screen flicker problem. The brightness/luminance holding ratio compensation of the invention is illustrated below.

In this embodiment, the backlight driving circuit 164 of the backlight module 160 drives the backlight source 162. In the display frame cycle, the backlight control circuit 166 forms a plurality of backlight shield-blocking periods. In the backlight shield-blocking periods, the backlight control circuit controls the backlight driving circuit to temporarily turn off or turn dark the backlight source or temporarily turn down the backlight source to a dark state.

Figure 4A:
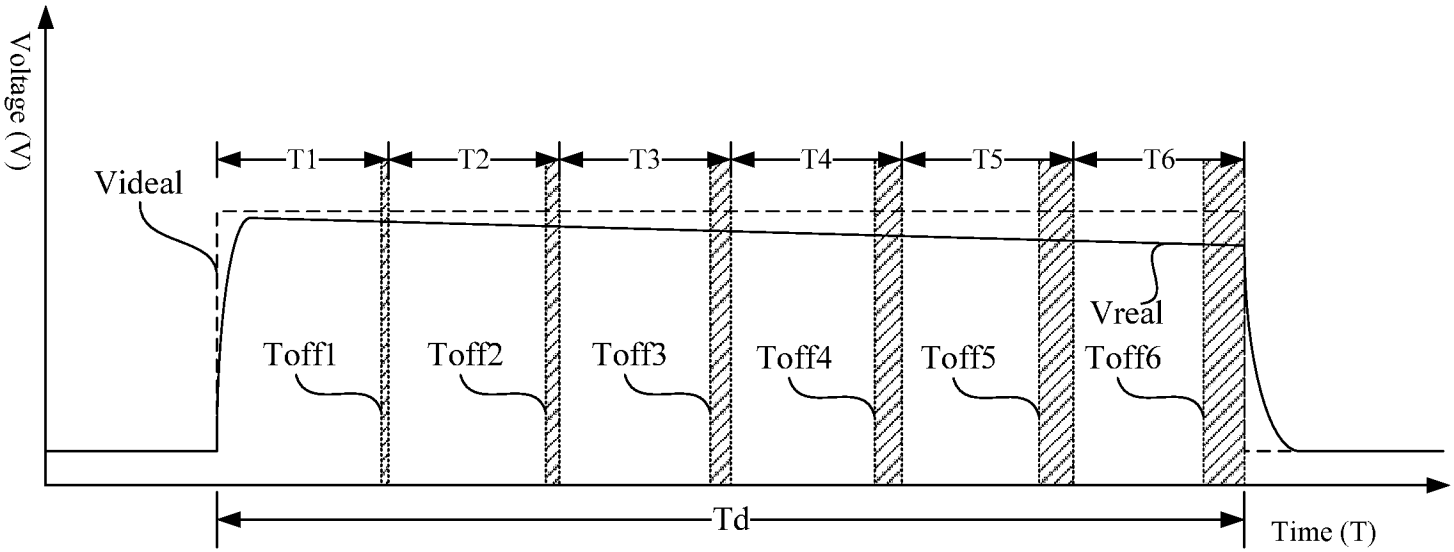
FIG. 4A illustrates a schematic view of a plurality of backlight shield-blocking periods formed in a display frame cycle.
Figure 4B:
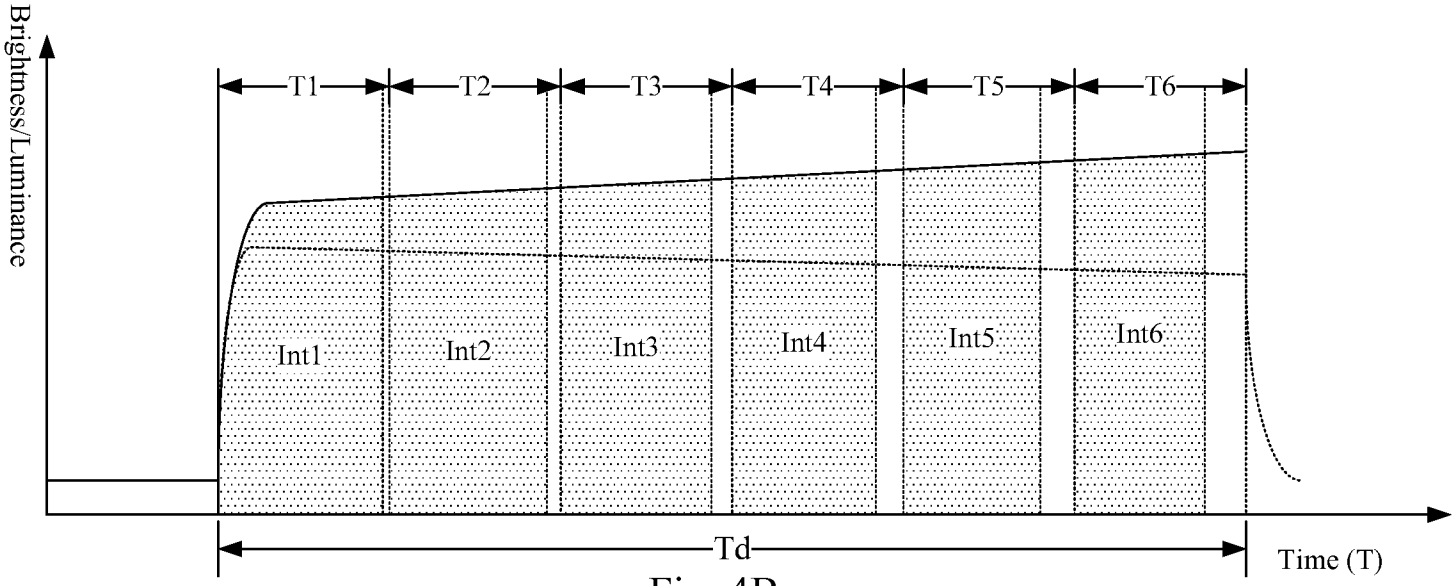
FIG. 4B illustrates a schematic view of the gradually increased brightness/luminance in a display frame cycle.

Referring to FIG. 4A, FIG. 4A illustrates a schematic view of a plurality of backlight shield-blocking periods formed in a display frame cycle Td. In a display frame cycle Td, if an ideal driving voltage $V_{ideal}$ exists and has the voltage holding ratio of 100%, the transmittance and the brightness/luminance of LCD panel 120 may keep constant. However, in actual situation, an actual driving voltage $V_{real}$ is non-ideal linear and is gradually attenuated over time. Hence, the transmittance and the brightness/luminance of the LCD panel 120 gradually increase. Referring to FIG. 4B, FIG. 4B illustrates a schematic view of the gradually increased brightness/luminance in the display frame cycle Td.

As shown in FIGS. 4A and 4B, the display frame cycle Td is divided into N cycle intervals. In this embodiment, the display frame cycle Td is divided into 6 cycle intervals T1-T6. The backlight control circuit 166 forms at least one backlight shield-blocking period in each cycle interval (T1-T6), thus totally forming, but not limited to at least 6 backlight shield-blocking periods in the invention.

Figure 4C:
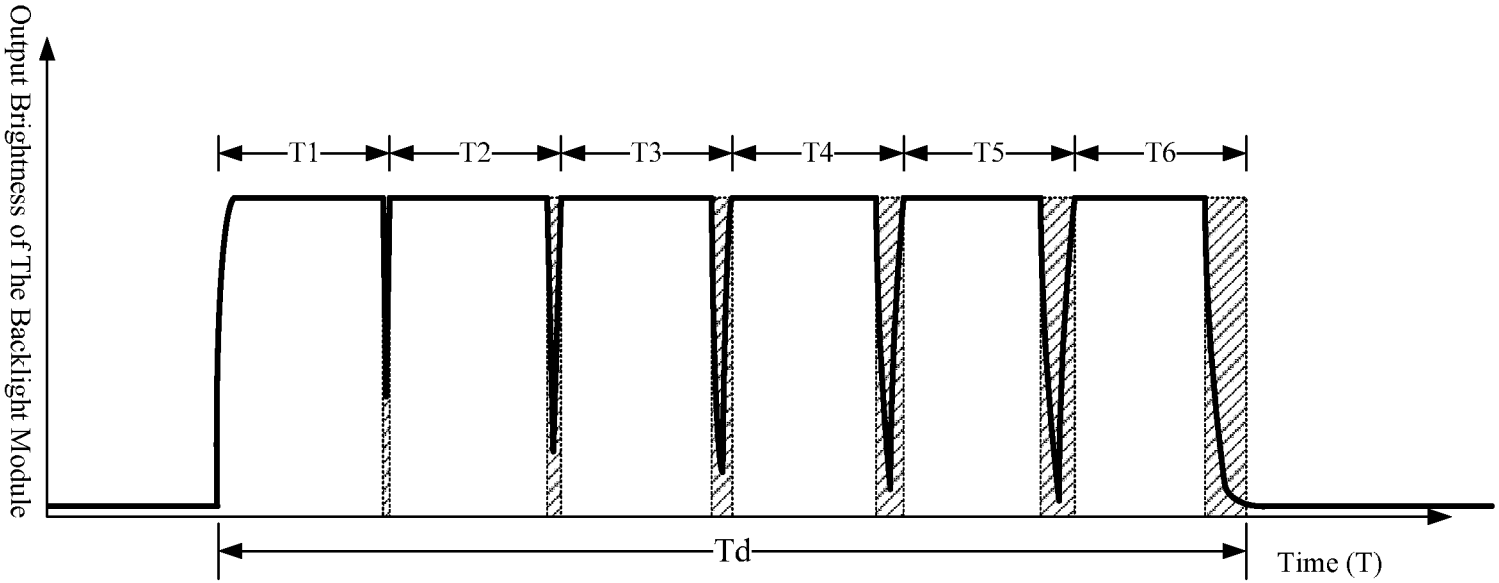
FIG. 4C illustrates a schematic view of the output of the backlight source decreased to a dark or dim state in the plurality of backlight shield-blocking periods formed in a display frame cycle.

At this time, the backlight control circuit 166 forms 6 backlight shield-blocking periods $T_{off1}$-$T_{off6}$ in the above 6 cycle intervals T1-T6. In the backlight shield-blocking periods $T_{off1}$-$T_{off6}$, the backlight control circuit 166 controls the backlight driving circuit 164 to temporarily turn off or turn dark the backlight source 162 or temporarily turn down the backlight source 162 to a dark or dim state. Referring to FIG. 4C, FIG. 4C illustrates a schematic view of the output of the backlight source 162 decreased to the dark or dim state in the plurality of backlight shield-blocking periods formed in the display frame cycle Td. Parameters of the shield-blocking periods are designed to make the backlight turn-on period correspond to the gradually increasing rate of the brightness/luminance in each cycle (according to different operating intervals in FIG. 2B), so as to make the optical time integration (e.g. optical time integrations Int1-Int6 in FIG. 4B) of the brightness/luminance in each cycle remain unchanged or stable, or have a variance less than 5%.

Referring to FIG. 4B, in FIG. 4B, the brightness/luminance of different cycle intervals T1-T6 increases over time. By forming backlight shield-blocking periods $T_{off1}$-$T_{off6}$ with different time length, the optical time integrations Int1-Int6 in each cycle interval T1-T6 (i.e. an equivalent total brightness/luminance in each cycle interval) remain unchanged or stable, or have a variance less than 5%.

In this embodiment, the integration formula may be expressed as:

$$A_k=\int_k B_{BL,k}(t,\text{on/off})\cdot T_{LC,k}(t)\cdot dt$$

where $A_k$ is the equivalent total brightness/luminance of the Kth cycle interval, $B_{BL}$ is the backlight brightness, on/off is the backlight switching period, $T_{LC}$ is the transmittance of the LCD panel, and K is the Kth cycle interval.

When the backlight driving current gradually or gradiently decreases, the integration formula of $A_k$, the equivalent total brightness/luminance is still effective, and $B_{BL}(t)$ backlight brightness changes along with the change of current or with the variation of gradients.

Hence, the screen flicker problem of the LCD apparatus 100 can be solved and the energy consumption of the backlight module 160 can be further saved by turning off the backlight source 162.

It should be noted that in this embodiment the LCD panel 120 may be a normally white mode transmissive LCD panel. When the driving voltage is attenuated, the transmittance of the LCD panel 120 increases over time, so the shield-blocking persistent period of the 6 backlight shield-blocking periods ($T_{off1}$-$T_{off6}$) formed by the backlight control circuit 166 sequentially increases, as shown in FIG. 4A.

Figure 4D:
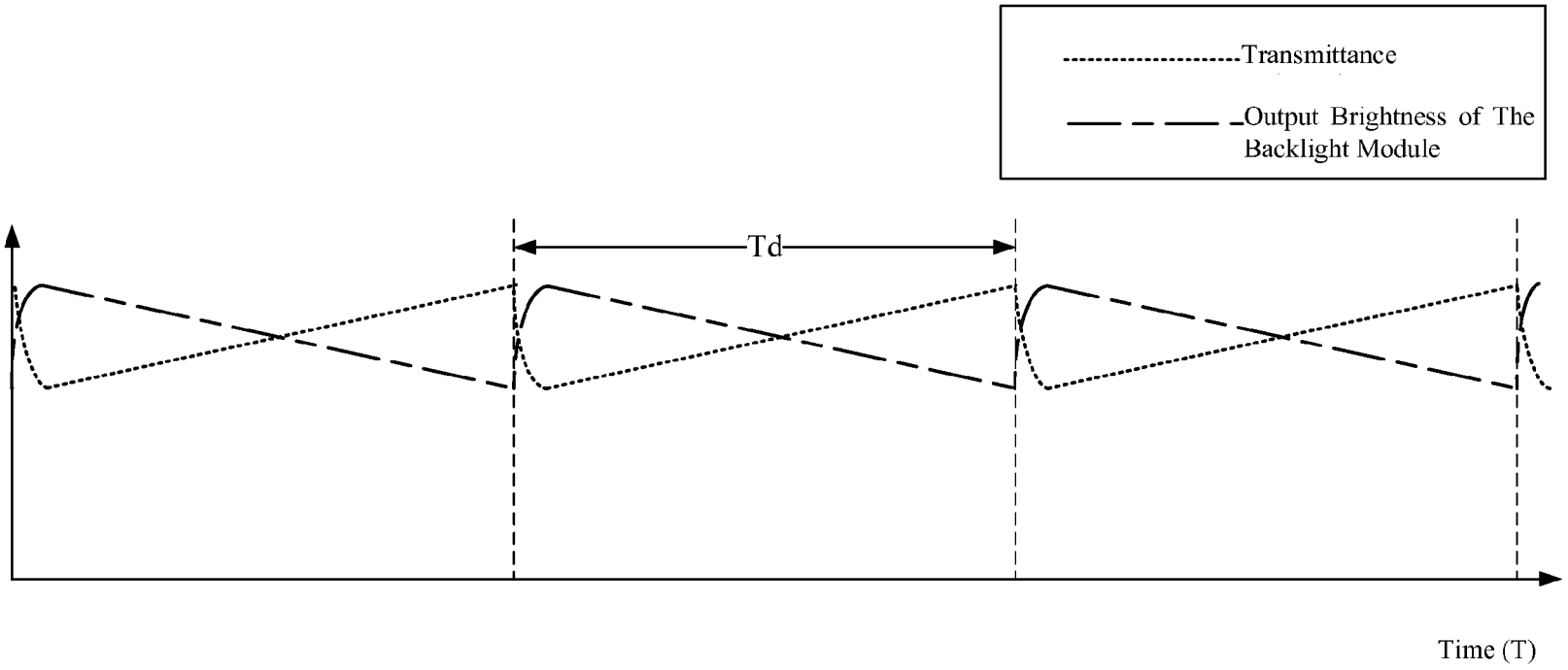
FIG. 4D illustrates a schematic view of the brightness/luminance compensation performed by gradually decreasing the backlight driving current.
Figure 4E:
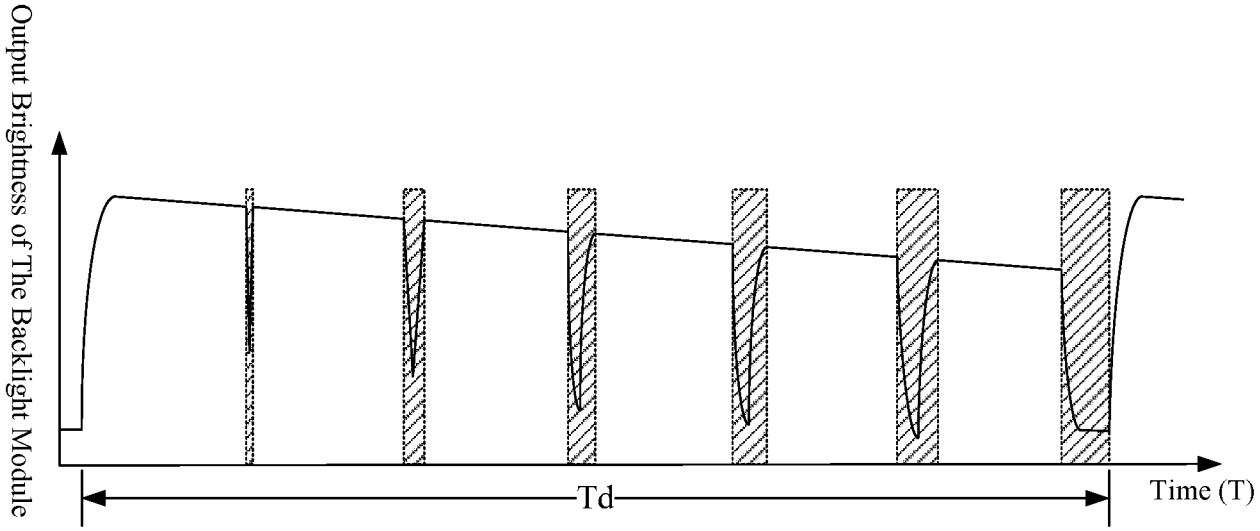
FIG. 4E illustrates a schematic view of a backlight shield-blocking period compensation and a backlight output brightness compensation used together.
Figure 5:
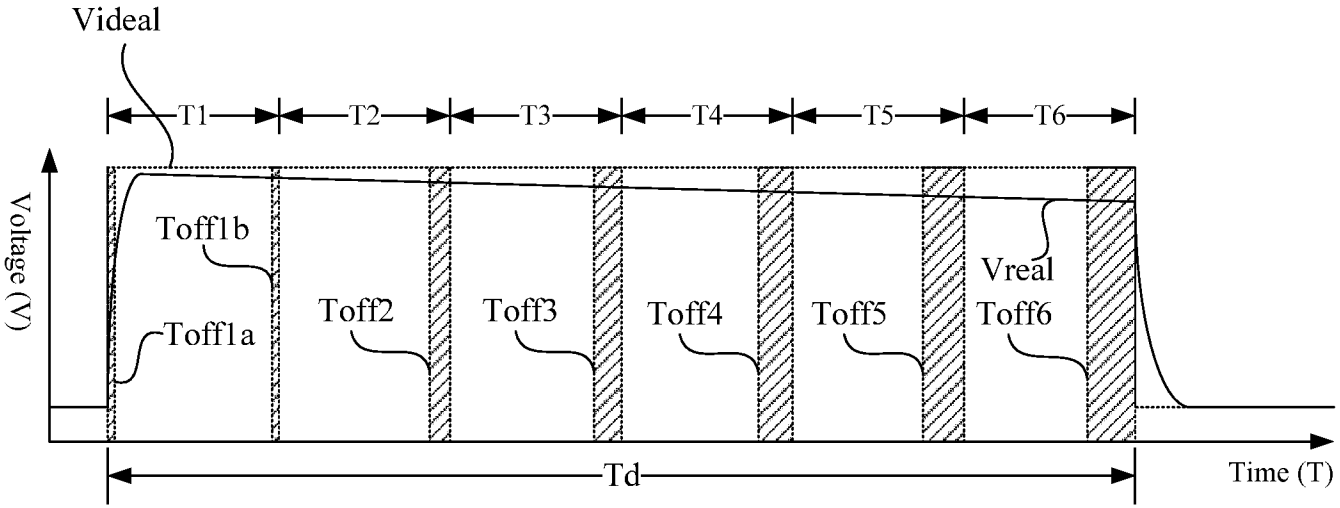
FIG. 5 illustrates a schematic view of another method for forming a plurality of backlight shield-blocking periods in a display frame cycle.

Moreover, referring to FIG. 5, FIG. 5 illustrates a schematic view of another method for forming a plurality of backlight shield-blocking periods in the display frame cycle Td. Different from FIG. 4, in FIG. 5, the backlight control circuit 166 forms the first backlight shield-blocking period $T_{off1a}$ at the start of the first cycle interval T1, or forms the second backlight shield-blocking period $T_{off6}$ at the end of the 6th cycle interval T6, and forms at least one backlight shield-blocking period $T_{off1b}$-$T_{off6}$ in the cycle intervals T1-T6. The first backlight shield-blocking period $T_{off1a}$ corresponds to a liquid crystal switching period (during which the driving voltage $V_{ideal}$ is in the progress of switching) of the LCD panel 120. The design of the first backlight shield-blocking period $T_{off1a}$ and the second backlight shield-blocking period $T_{off6}$ can improve the liquid crystal switching speed of the LCD panel 122.

In the method based on the adjustment of the backlight shield-blocking period, taking 60 Hz. as an example, in a static state frame or image, when 60 Hz. is decreased to 5 Hz, the voltage holding ratio (VHR) of the LCD panel decreases from 98.5%-99.5% to 90%-94%. That is, at 5 Hz, the change of the brightness/luminance has the blink of 6%-10%. The invention utilizes the shield-blocking periods to make the difference and variance of the brightness/luminance in each cycle interval be less than or equal to 5% or 3%. At this time, the power consumption of the LCD panel driving is reduced by (60–5)/60=91%, and is reduced to 9% of the original power consumption.

It should be explained that due to the adjustment of the backlight shield-blocking periods, 5%-10% of the display brightness is lost, but the power consumption of the backlight is also reduced by 5%-10% correspondingly. Thus the power consumption of the backlight does not increase. In practical applications, in order to maintain the original display brightness, the cost of the backlight is increased for increasing the brightness by 5%-10%.

However, the LCD panel 120 of the LCD apparatus 100 of the invention is not limited to the normally white mode. In another embodiment, a normally black mode LCD panel is adopted. In the situation of the normally black mode LCD panel, when the driving voltage is attenuated, the transmittance of the LCD panel decreases over time. Accordingly, the shield-blocking persistent period of the backlight shield-blocking periods formed by the backlight control circuit sequentially decreases, thereby solving the screen flicker problem and achieving the power saving effect. Therefore, the brightness/luminance holding ratio compensation architecture of the LCD apparatus 100 of the invention is not limited to be applied in the normally white mode or normally black mode LCD panel.

Moreover, the second embodiment of the invention provides an LCD apparatus with brightness/luminance holding ratio compensation. The internal architecture of the LCD apparatus is substantially similar to that of the LCD apparatus 100 of the first embodiment, referring to FIG. 1 of the first embodiment above.

In the first embodiment, the working brightness configuration of the backlight module substantially remains unchanged. The compensation balance of the total brightness/luminance is achieved mainly by forming backlight shield-blocking periods of different lengths.

In the second embodiment, the major difference between the LCD apparatus 100 and that of the first embodiment lies in that, in the display frame cycle, the backlight control circuit 166 controls the backlight driving circuit 164 to gradually or gradiently adjust the backlight driving current, so as to make the brightness/luminance of the backlight source 162 change over time, instead of forming the backlight shield-blocking periods and temporarily turning off the backlight source 162. In other words, in the second embodiment, the compensation balance of total brightness/luminance is achieved mainly by adjusting the output brightness of the backlight module.

Definitely, the method of the backlight shield-blocking periods in the first embodiment and the method of controlling the backlight driving circuit in the second embodiment may be used together.

In the second embodiment, if the LCD panel 120 is the normally white mode LCD panel, the backlight control circuit 166 controls the backlight driving circuit 164 to gradually or gradiently decrease the backlight driving current in the display frame cycle, so as to make the brightness/luminance of the backlight source 162 decrease over time.

The variation curve of the transmittance or brightness versus the liquid crystal driving voltage of the LCD panel 120 is divided into a plurality of gray level intervals. Each of the gray level intervals corresponds to a compensation coefficient of the backlight control circuit. During each gray level interval, the backlight control circuit 166 gradually or gradiently decreases the backlight driving current according to the compensation coefficient, so as to make the brightness/luminance of the backlight source 162 decrease over time.

As shown in FIG. 2A, the gray level curve in FIG. 2A may be divided into several operating intervals (e.g. operating intervals Z1, Z2 and Z3). The brightness/luminance-voltage curve may have several linear slopes and includes several operating intervals Z1, Z2 and Z3. A majority of the gray level is concentrated in the operating interval Z1, i.e., the driving voltages Vth-V1. The operating interval Z2 has a small range, i.e., the driving voltages V1-V2, and the brightness of the operating interval Z2 is lower than 10%. The brightness of the operating interval Z3 is lower than 5%, i.e. the driving voltages V2-Vsat.

When the VHR drops from 100% to 90%, the voltage changes by 5%-15%, and the L-V curve of the brightness/luminance versus voltage correspondingly changes by 5%-15%. As the voltage, current, brightness/luminance of the LED backlight module are almost linear in the operating intervals, by the characteristic of adjusting the current of the LED backlight module, only 2-3 compensation coefficients (the operating intervals Z1-Z3) may be used to meet the requirement of the apparatus of the invention.

The display frame cycle may be further divided into N cycle intervals. In each cycle interval, the backlight control circuit 166 controls the backlight driving circuit 164 to gradually or gradiently decrease the backlight driving current. Referring to FIG. 4D, FIG. 4D illustrates a schematic view of the brightness/luminance compensation performed by gradually decreasing the backlight driving current.

As shown in FIG. 4D, the brightness/luminance of the backlight source 162 gradually decreases (gradiently decreases in another embodiment) along with different cycle intervals. Parameters of the backlight driving current are designed to make the changes of the backlight brightness/luminance and transmittance of liquid crystal cell in all cycles correspond to one another, so as to make the optical time integration of the brightness/luminance of each cycle remain unchanged or stable, or have variance less than 5%.

In this embodiment, the integration formula may be expressed as:

$$A_k=\int_k B_{BL,k}(I(t))\cdot T_{LC,k}(t)\cdot dt$$

where $A_k$ is the equivalent total brightness/luminance of the Kth cycle interval, $B_{BL}$ is the backlight brightness, and the backlight brightness changes over time. In this embodiment, the backlight driving current I(t) that changes over time may be adopted, $B_{BL}$ is the backlight brightness $B_{BL}=B_{BL}(I(t))$, $T_{LC}$ is the transmittance of the LCD panel, and K is the Kth cycle interval.

On the other hand, in the second embodiment, if the LCD panel 120 is the normally black mode LCD panel, the backlight control circuit 166 controls the backlight driving circuit 164 to gradually or gradiently increase the backlight driving current in the display frame cycle, so as to make the brightness/luminance of the backlight source 162 increase over time.

The variation curve of the transmittance or brightness versus the liquid crystal driving voltage of the LCD panel 120 is divided into a plurality of gray level intervals. Each of the gray level intervals corresponds to a compensation coefficient of the backlight control circuit 166. During each gray level interval, the backlight control circuit 166 controls the backlight driving circuit 164 to gradually increase the backlight driving current according to the compensation coefficient, so as to make the brightness/luminance of the backlight source 162 increase over time.

The display frame cycle may be further divided into N cycle intervals. In each cycle interval, the backlight control circuit 166 controls the backlight driving circuit 164 to gradually increase the backlight driving current, so as to make the brightness/luminance of the backlight source 162 increase along with different cycle intervals.

In the method based on the adjustment of the backlight driving current, taking 60 Hz as an example, in the static state frame or image, when 60 Hz is decreased to 5 Hz, the voltage holding ratio (VHR) of the LCD panel decreases from 98.5%-99.5% to 90%-94%. That is, at 5 Hz, the change of the brightness/luminance has the blink of 6%-10%. The invention utilizes the backlight driving current to gradually or gradiently adjust and make the difference and variance of the brightness/luminance in each cycle interval be less than or equal to 5% or 3%. At this time, the power consumption of the LCD panel driving is reduced by (60−5)/60=91%, and is reduced to 9% of the original power consumption.

Definitely, the method of the backlight shield-blocking periods in the first embodiment and the method of controlling the backlight driving circuit in the second embodiment may be used together. In other words, the backlight shield-blocking periods of different lengths are adopted and the backlight output brightness is adjusted to achieve the compensation balance of the brightness/luminance. Referring to FIG. 4E, FIG. 4E illustrates a schematic view of a backlight shield-blocking period compensation and a backlight output brightness compensation used together.

Moreover, in the first embodiment and the second embodiment of the invention, a gray level display driving conversion reference table may be set according to various possible displayed contents, to realize the LCD apparatus having the better power saving effect. The LCD apparatus has a transmissive or transflective normally white mode LCD panel. In the LCD panel of the LCD apparatus, when the gray level display configuration has the low brightness/luminance, the conversion reference table is a conversion reference table where the gray level display driving corresponds to the compensation level of the low backlight driving current. In other words, the backlight module further includes a display driving conversion reference table. That is, in the display frame cycle, the backlight module controls the backlight driving circuit according to the display driving conversion reference table, so as to compensate the effect of the transmittance increasing or decreasing over time.

A correspondence relationship is established between the gray level display driving, the gray level display driving level of the lower voltage and low power consumption, and the compensation level of the low backlight driving current. When the backlight module has a backlight driving architecture with an area scanning backlight function, the gray level display driving conversion reference table may also correspond to each area respectively. Hence, the power saving effect is achieved without changing the overall display brightness/luminance.

As shown in FIG. 3, FIG. 3 illustrates a schematic view of the gray level/brightness versus the relative power consumption (Power=$V^2$/R). It may be known from the figure that the dark gray level of 0%-15% have a high relative power consumption up to 30%-100%, and the bright gray level of 100%-20% have a low relative power consumption lower than 30%. The invention utilizes the bright gray level, i.e. the gray level of the low power consumption for converting the dark gray level with high power consumption.

In the first embodiment and the second embodiment of the invention content, the backlight module 160 may further has the backlight driving architecture with the area scanning backlight function. The backlight module 160 with the area scanning backlight function calculates and determines the display content of the image data of each area, and then automatically converts the low brightness gray level of the gray level display configuration of the image data of every area into the lower driving voltage correspondingly. The backlight module may respectively and automatically sets the corresponding low backlight driving current serving as the compensation level for each area. The display content of each area may determine the lower driving voltage level and the compensation level of the low backlight driving current. Thus, the gray level display driving of the image data of each area is converted into another gray level display driving level with the low power consumption.

Moreover, after calculating and determining the display content of each area, the above backlight driving architecture with the area scanning backlight function may respectively and automatically convert the low brightness gray level of the gray level display configuration of each area into the driving voltage of the lower-voltage gray level or a high brightness gray level correspondingly. The backlight module may respectively and automatically set a corresponding proportion of the backlight turn-on/turn-off period (backlight on/off period ratio) or proportion of the plurality of backlight shield-blocking periods in each display frame cycle for and area, so as to decrease the brightness/luminance of the backlight source in the display frame cycle for compensation. Thus, the LCD apparatus is driven at the low refresh rate to achieve the effect of better power saving effect.

The backlight driving architecture with the area scanning backlight function may further set a conversion reference table of the gray level display driving versus the backlight on/off period ratio or the proportion of the plurality of backlight shield-blocking periods according to various possible displayed contents and establish a correspondence relationship between the gray level display driving, the gray level display driving level of the lower-voltage and the low power consumption, and the compensation level of the proportion of the backlight turn-on/turn-off period. When the backlight module has the backlight driving architecture with the area scanning backlight function, the gray level display driving conversion reference table may also correspond to each area respectively.

Figure 6:
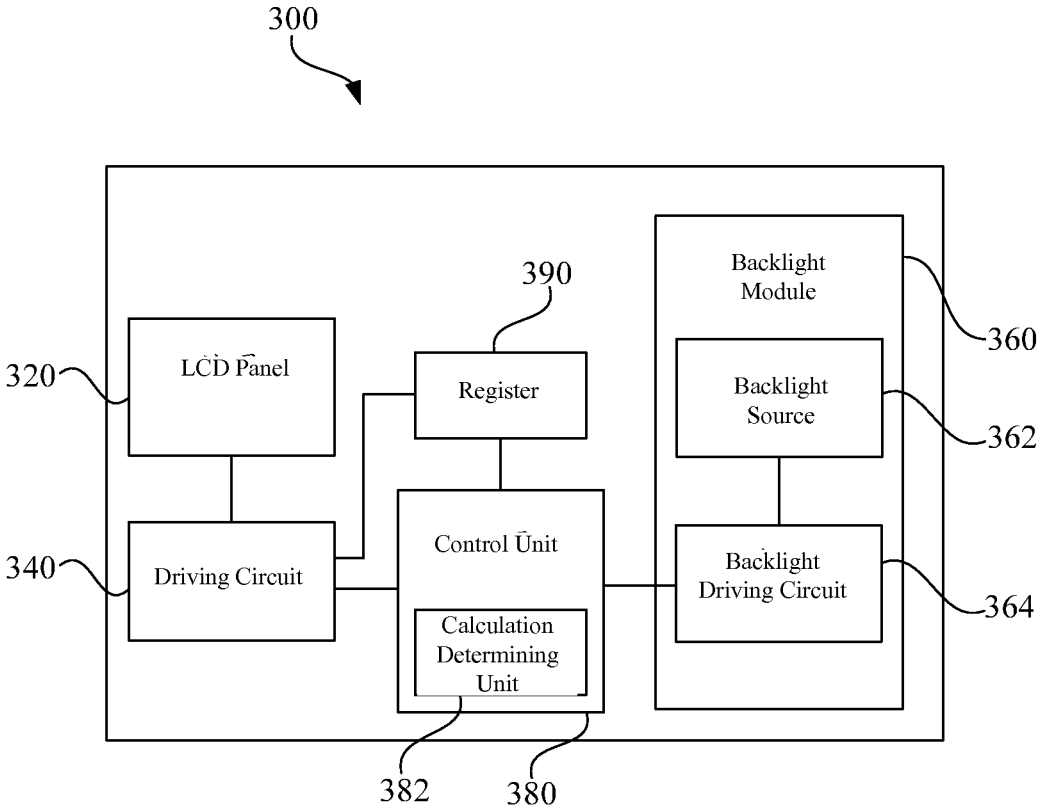
FIG. 6 illustrates a function block diagram of an LCD apparatus adopting a low-voltage gray level conversion method according to a third embodiment of the invention.

Next, referring to FIG. 6, FIG. 6 illustrates a function block diagram of an LCD apparatus 300 adopting a low-voltage gray level conversion method according to a third embodiment of the invention. As shown in FIG. 6, the LCD apparatus 300 includes an LCD panel 320, a driving circuit 340, a control unit 380 and a backlight module 360. The backlight module 360 includes a backlight source 362, a backlight driving circuit 364 and a backlight control circuit 366. The control unit 380 further includes a calculation determining unit 382.

The LCD panel 320 is the transmissive or transflective normally white mode LCD panel. Referring to FIG. 2A, FIG. 2A illustrates a curve diagram of the driving voltage versus the brightness/luminance of the normally white mode LCD panel.

As shown in FIG. 2A, when the driving voltage of the normally white mode LCD panel 320 is low, the molecule arrangement of the normally white mode liquid crystal layer has the high transmittance mode, thus having the high brightness/luminance. Accordingly, when the driving voltage is the high voltage, the liquid crystal layer in the normally white mode rotates and twists to decrease the transmittance of the LCD panel 320, thus having the low brightness/luminance.

In this embodiment, the LCD apparatus 300 of the invention may perform the gray level display driving conversion by utilizing the above gray level curve characteristic (as shown in FIG. 2A), so as to achieve the effect of better power saving effect.

In the LCD panel 320 of the LCD apparatus 300, when the gray level display configuration is the low brightness/luminance gray level, i.e., the gray level display configuration utilizes the high driving voltage (at the low transmittance) for driving. Generally, in a preset situation, the conventional backlight module is mainly constantly set at the full bright state with the high brightness/luminance of the high backlight driving current. Therefore, in the prior art, when the display frame has the low brightness, the normally white mode LCD panel needs a high driving voltage to achieve the low transmittance (the backlight module is preset at the full bright state), so as to display the display frame with low brightness. Hence, the LCD panel and the backlight module have large power consumption.

Referring to FIG. 2A, FIG. 3 illustrates a curve diagram of the brightness/luminance corresponding to the driving voltage versus the relative power consumption proportion of different operating intervals Z1-Z3 in FIG. 2A. As shown in FIG. 3, the main operating gray level range of the operating interval Z1 is large and the power consumption is relatively small. The gray level ranges of the operating intervals Z2 and Z3 are small and the power consumption is quite large.

In the third embodiment of the invention, the LCD apparatus 300 after calculates and determines the contents of the display image data, and then automatically converts the low brightness/luminance gray level of the gray level display configuration of the image data into the lower driving voltage (high transmittance) adopted by the LCD panel 320 correspondingly. The backlight module 360 may be automatically set to have the low backlight driving current (low brightness/luminance) correspondingly. Thus, the power consumption of the LCD panel may be greatly decreased, since the gray level display configuration is changed to "the low driving voltage" from "the high driving voltage" and the power consumption is in direct proportion to a square of voltage ($Power=V^2/R$). Meanwhile, the power consumption of the backlight module may also be greatly reduced due to the low backlight driving current and because the power consumption is in direct proportion to a square of current ($Power=R*I^2$). In this regard, the gray level display driving is converted into another the gray level display driving with the lower voltage, thereby achieving the power saving effect without changing the overall display brightness/luminance. For example, the operating interval Z1 may be utilized to replace the gray level brightness of the operating interval Z2 or Z3 (as shown in FIGS. 2A and 2B).

In other words, in the LCD apparatus 300 of the third embodiment, when the display image data is the dark image, or an average value of the driving voltage of the display image data is higher than the driving voltage reference value, the LCD panel 320 has the low transmittance, so the control unit 380 informs the driving circuit 340 of decreasing the driving voltage, to increase the transmittance of the LCD panel 320 and decrease the backlight driving current or the brightness/luminance of the backlight module 360.

In the LCD apparatus 300 in FIG. 6, the control unit 380 may have a calculation determining unit 382 for performing the image/data calculating and analyzing. Taking the normally white mode as an example, the calculation determining unit 382 may capture the image data of the register 390 and then make analysis and determination. When the image is mostly the dark frame (e.g. the average brightness/luminance is lower than 20% or 10%), or the brightest part of the image data (e.g. the brightest part 20%) is lower than a level, according to the comparison table or preset calculated compensation coefficient, the operation and conversion are made to generate the new bright image data with low-voltage gray level and low power consumption, and meanwhile the backlight module 360 is controlled to decrease the brightness/luminance accordingly.

The method of adjusting the brightness/luminance of the backlight module 360 by the control unit 380 may refer to the method of the first embodiment. In the display frame cycle, the control unit 380 controls the driving circuit 340 and the backlight driving circuit 364. Accordingly, the driving circuit 340 decreases the driving voltage to increase the transmittance of the LCD panel 320 and form a plurality of backlight shield-blocking periods. In the backlight shield-blocking periods, the backlight driving circuit 364 temporarily turns off the backlight source 362 or temporarily turns down the backlight source 362 to the dark state and controls the proportion of the backlight turn-on or turn-off period to decrease the brightness/luminance of the backlight module.

Moreover, in the above embodiments of the invention, for the LCD apparatus with the low refresh rate, in the display frame cycle, the backlight shield-blocking persistent period of the backlight shield-blocking periods sequentially increases.

Moreover, in the above embodiments of the invention, the method of adjusting the brightness/luminance of the backlight module 360 by the control unit 380 may refer to the method in the second embodiment. In the display frame cycle, the control unit 380 controls the driving circuit 340 and the backlight driving circuit 364. Subsequently, the driving circuit 340 decreases the driving voltage to increase the transmittance of the LCD panel 320. The backlight driving circuit 340 decreases the backlight driving current or the brightness/luminance of the backlight module 360.

Moreover, in the above embodiments of the invention, for the LCD apparatus with the low refresh rate, in the display frame cycle, the backlight driving current sequentially or gradiently decreases.

Moreover, in the above embodiments of the invention, the refresh rate is lower than or equal to 20 Hz.

According to another embodiment of the invention, the LCD panel has two or more refresh rates.

With the above method, the LCD apparatus 300 adopting the low-voltage gray level conversion method of the invention utilizes the low-power-consumption display configuration with the low driving voltage, high transmittance and low backlight brightness to replace the high-power-consumption display configuration with the high driving voltage, low transmittance and high backlight brightness, thereby achieving the similar display effect.

Moreover, in the third embodiment of the invention, the backlight module 360 may further have the backlight driving architecture with the area scanning backlight function. After calculating and determining the display contents of all areas, the backlight module 360 with the area scanning backlight function may respectively and automatically convert the low brightness gray level of the gray level display configuration of each area in to the lower driving voltage correspondingly. The backlight module may respectively and automatically set a corresponding low backlight driving current serving as the compensation level for each area. The display content of each area determines the lower driving voltage level and the compensation level of the low backlight driving current of the area. Thus, the gray level display driving of each area is converted into another gray level display driving with the low power consumption.

Moreover, in the third embodiment of the invention, the gray level display driving conversion reference table may be set according to various possible displayed contents, i.e., a conversion reference table of the gray level display driving versus a compensation level of the low backlight driving current. In other words, the backlight module 360 or the control unit 380 further includes a display driving conversion reference table. That is, in the display frame cycle, the backlight module 360 controls the backlight driving circuit 364 according to the display driving conversion reference table, so as to compensate the effect of the transmittance increasing or decreasing over time.

A correspondence relationship is established between the gray level display driving, the gray level display driving level of the low voltage and low power consumption, and the compensation level of the low backlight driving current. When the backlight module has the backlight driving architecture with the area scanning backlight function, the gray level display driving conversion reference table may also correspond to each area. Hence, the power saving effect is achieved without changing the overall display brightness/luminance.

Referring to FIGS. 2A and 3, the normally white mode LCD panel, the gray level display driving voltage corresponding to each gray level, and the relative power consumption (Power=$V^2$/R) corresponding to each gray level are illustrated. Therefore, it is known that 15% dark gray level results in the relative power consumption of 30%-100%, and 85% bright gray level results in the relative power consumption lower than or equal to 30%.

Hereinafter, the power saving effect of the invention is explained by a table. Please refer to Table 1 below.

TABLE 1

| Original Driving Voltage (V) | Original Relative Brightness/ Luminance (L) | Original Relative Proportion of Power | Adjusted Brightness/ Luminance (×4) | L' | Adjusted Relative Proportion of Power |
|---|---|---|---|---|---|
| 0 | 100% | 0% | | L25 | 0% |
| 1.1 | 98% | 5% | | | |
| 1.6 | 75% | 10% | | L19 | 10% |
| 1.85 | 60% | 14% | | L15 | 14% |
| 2 | 50% | 16% | | | |
| 2.4 | 30% | 23% | | L8 | 23% |
| 2.5 | 25%(L25) | 25% | 100% | | |
| 2.8 | 15%(L15) | 31% | 60% | L4 | 31% |
| 3.1 | 8%(L8) | 38% | 32% | | |
| 3.6 | 4%(L4) | 52% | 16% | L1 | 52% |
| 4.5 | 1%(L1) | 81% | 4% | | |
| 5 | 0.1%(L0) | 100% | 0% | | |

In the examples listed in Table 1, (1) the average brightness of the pixels in the area is decreased to 10% of the original value; or (2) the average brightness of the 20% brightest pixels in the area is decreased to 10% of the original value.

In the left column of Table 1, the most power consumption is caused by L=0-8%. That is, when the brightness/luminance or the gray level is the darkest 8% gray level, the most power consumption is caused. The relative proportion of the power consumption is 100%-38%.

In a certain cycle, in a display area, the gray level of 0-8% of the display gray level of the LCD panel is improved by ×6-×10. The gray level is improved to be gray level of 0%-50% or 0%-80%. Meanwhile, the backlight area decreases the backlight driving current to decrease the backlight brightness to be about 1/5-1/10, or adjust the backlight on/off period ratio to decrease the backlight brightness to be about 1/5-1/10. Thus, the power saving effect of the panel is listed on the right of the Table 2 below.

TABLE 2

| Original Driving Voltage | Original Relative Brightness/ Luminance | Original Power Consumption Proportion | Adjusted Brightness/ Luminance | Adjusted Power Consumption Proportion | Saved Power Consumption | Relative Proportion of Saved Power Consumption |
|---|---|---|---|---|---|---|
| 3.1 | 8% | **38%** | 80% | **9%** | **29%** | **77%** |
| 3.6 | 4% | **52%** | 40% | **20%** | **32%** | **61%** |
| 4.5 | 1% | **81%** | 10% | **35%** | **46%** | **57%** |
| 5 | 0.1% | **100%** | 1% | | | |

The relative proportion of power consumption may be decreased from P=100%-38% to P=35%-9%. The relative saved power consumption is 57%-77%. The backlight decreases the backlight driving current so as to decrease the backlight brightness to be 1/5-1/10, so the power consumption is decreased to be 1/5-1/10. The relative saved power consumption is 80%-90%.

Although the invention has been disclosed with reference to the above embodiments, these embodiments are not intended to limit the invention. It will be apparent to those skilled in the art that various modifications and variations can be made without departing from the scope and spirit of the invention. Therefore, the scope of the invention shall be defined by the appended claims.

What is claimed is:

1. A liquid crystal display apparatus with brightness/luminance holding ratio compensation, comprising:

a liquid crystal display panel having a refresh rate, wherein a transmittance or brightness/luminance of the liquid crystal display panel changes over time in a display frame cycle;

a driving circuit for driving the liquid crystal display panel according to a driving voltage; and a register, for catching an image information;

a backlight module comprising:

a backlight source;

a backlight driving circuit for driving the backlight source;

a controller, coupled to the register, the driving circuit and the backlight driving circuit, wherein the controller comprises a calculation determiner, for capturing the image information of the register and analyzing the image information; the controller is configured to supply a control signal to the backlight driving circuit based on the image information; and a backlight control circuit for forming a plurality of backlight shield-blocking periods in the display frame cycle and controlling the backlight driving circuit to temporarily turn off or turn dark the backlight source or temporarily turn down the backlight source to a dark state in the backlight shield-blocking periods, the display frame cycle is divided into a plurality of cycle intervals, the whole display frame cycle corresponds to one fixed gray level, and the backlight control circuit forms at least one backlight shield-blocking period in each cycle interval, a shield-blocking persistent length of the backlight shield-blocking periods sequentially increases when the liquid crystal display panel is a normally white mode liquid crystal display panel and the driving voltage is attenuated;

wherein when the driving voltage is attenuated, the transmittance of the of the liquid crystal display panel increases over time.

2. The liquid crystal display apparatus of claim 1, wherein the refresh rate is lower than or equal to 20 Hz.

3. The liquid crystal display apparatus of claim 1, wherein the liquid crystal display panel has two or more refresh rates.

4. The liquid crystal display apparatus of claim 1, wherein the liquid crystal display panel is a normally black mode liquid crystal display panel, and the shield-blocking persistent length of the backlight shield-blocking periods sequentially decreases in the display frame cycle.

5. The liquid crystal display apparatus of claim 1, wherein the backlight control circuit further comprises a display driving conversion reference table, and during the display frame cycle, the backlight control circuit controls the backlight driving circuit to turn off or turn dark the backlight source and forms the backlight shield-blocking periods according to the display driving conversion reference table, so as to compensate the effect of the transmittance increasing or decreasing over time.

6. The liquid crystal display apparatus of claim 1, wherein the display frame cycle is divided into N cycle intervals, and the backlight control circuit forms at least one backlight shield-blocking period in each cycle interval, thus totally forming at least N backlight shield-blocking periods.

7. The liquid crystal display apparatus of claim 1, wherein the display frame cycle is divided into N cycle intervals, and the difference of an optical integration of the transmittance or brightness/luminance of the liquid crystal display apparatus to time for each cycle interval is less than or equal to 5%.

8. A liquid crystal display apparatus with brightness/luminance holding ratio compensation, at least comprising:

a liquid crystal display panel, having a refresh rate, wherein a transmittance or brightness/luminance of the liquid crystal display panel changes over time in a display frame cycle;

a driving circuit, for driving the liquid crystal display panel according to a driving voltage; and a register, for catching an image information;

a backlight module, comprising:

a backlight source;

a backlight driving circuit, providing a backlight driving current for driving the backlight source;

a controller, coupled to the register, the driving circuit and the backlight driving circuit, wherein the controller comprises a calculation determiner, for capturing the image information of the register and analyzing the image information; the controller is configured to supply a control signal to the backlight driving circuit based on the image information; and a backlight control circuit, controlling the backlight driving circuit to gradually or gradiently adjust the backlight driving current in the display frame cycle, so as to make the brightness/luminance of the backlight source change over time, wherein the display frame cycle is divided into N cycle intervals, the whole display frame cycle corresponds to one fixed gray level, the backlight control circuit controls the backlight driving circuit to gradually modulate the backlight driving current in the display frame cycle, a shield-blocking persistent length of a plurality of backlight shield-blocking periods sequentially increases when the liquid crystal display panel is a normally white mode liquid crystal display panel and the driving voltage is attenuated;

wherein when the driving voltage is attenuated, the transmittance of the of the liquid crystal display panel increases over time.

9. The liquid crystal display apparatus of claim 8, wherein the liquid crystal display panel has two or more refresh rates.

10. The liquid crystal display apparatus of claim 8, wherein the liquid crystal display panel is the normally white mode liquid crystal display panel, the backlight control circuit controls the backlight driving circuit to gradually or gradiently decrease the backlight driving current in the display frame cycle, so as to make the brightness/luminance of the backlight source decrease over time.

11. The liquid crystal display apparatus of claim 10, wherein a variation curve of a transmittance or brightness/luminance versus a liquid crystal driving voltage of the liquid crystal display panel is divided into a plurality of gray level intervals, each of the gray level intervals corresponds to a compensation coefficient of the backlight control circuit, and during each gray level interval, the backlight control circuit controls the backlight driving circuit to gradually or gradiently decrease the backlight driving current according to the compensation coefficient, so as to make the brightness/luminance of the backlight source decrease over time.

12. The liquid crystal display apparatus of claim 10, wherein the display frame cycle is divided into N cycle intervals, and in each cycle interval, the backlight control circuit controls the backlight driving circuit to gradually or gradiently decrease the backlight driving current, so as to make the brightness/luminance of the backlight source decrease along with different cycle intervals.

13. The liquid crystal display apparatus of claim 8, wherein the liquid crystal display panel is a normally black mode liquid crystal display panel, and during the display frame cycle, the backlight control circuit controls the backlight driving circuit to gradually or gradiently increase the backlight driving current, so as to make the brightness/luminance of the backlight source increase over time.

14. The liquid crystal display apparatus of claim 13, wherein a variation curve of the transmittance or brightness/luminance versus a liquid crystal driving voltage of the liquid crystal display panel is divided into a plurality of gray level intervals, each of the gray level intervals corresponds to a compensation coefficient of the backlight control circuit, and during each gray level interval, the backlight control circuit controls the backlight driving circuit to gradually or gradiently increase the backlight driving current according to the compensation coefficient, so as to make the brightness/luminance of the backlight source increase over time.

15. The liquid crystal display apparatus of claim 13, wherein the display frame cycle is divided into N cycle intervals, and in each cycle interval, the backlight control circuit controls the backlight driving circuit to gradually or gradiently increase the backlight driving current, so as to make the brightness/luminance of the backlight source increase along with different cycle intervals.

16. The liquid crystal display apparatus of claim 8, wherein the backlight control circuit further comprises a display driving conversion reference table, and during the display frame cycle, the backlight control circuit controls the backlight driving circuit according to the display driving conversion reference table, so as to compensate the effect of the transmittance increasing or decreasing over time.

17. The liquid crystal display apparatus of claim 8, wherein the display frame cycle is divided into N cycle intervals, and the difference of an optical integration of the transmittance or brightness/luminance of the liquid crystal display apparatus to time for each cycle interval is less than or equal to 5%.

18. A liquid crystal display apparatus, comprising:

a register, for catching an image information;

a liquid crystal display panel, wherein the liquid crystal display panel is a transmissive or transflective normally white mode liquid crystal display panel and has a refresh rate;

a driving circuit, for driving the liquid crystal display panel according to a driving voltage, wherein the liquid crystal display panel has a transmittance or brightness/luminance according to the driving voltage;

a backlight module, comprising:

a backlight source; and a backlight driving circuit, providing a backlight driving current for driving the backlight source, so as to make the backlight source generate a light ray passing through the liquid crystal display panel; and a controller, coupled to the register, the driving circuit and the backlight driving circuit, a controller, coupled to the register, the driving circuit and the backlight driving circuit, wherein the controller comprises a calculation determiner, for capturing the image information of the register and analyzing the image information;

wherein the controller calculates and determines the image information of the register, and supplies a control signal to the backlight driving circuit based on the image information, wherein when an average driving voltage value of the image information is higher than a driving voltage reference value, the transmittance is low, and thus the control unit automatically converts the driving voltage of the image information to a lower driving voltage, so as to increase the transmittance, and correspondingly decreases the level of the backlight driving current or the brightness/luminance of the backlight module, or correspondingly adjusts the turn-on, turn-off or turn-dark period of the backlight, the backlight module automatically sets a proportion of the backlight turn-on, turn-off or turn-dark period or a proportion of a plurality of backlight shield-blocking periods in each display frame cycle, so as to decrease the brightness/luminance of the backlight source in the display frame cycle for compensation, thereby corresponding to the brightness levels of the high transmittance at the lower driving voltage levels, the whole of each display frame cycle corresponds to one fixed gray level, and a backlight control circuit forms at least one backlight shield-blocking period in each cycle interval, a shield-blocking persistent lengths of the backlight shield-blocking periods sequentially increases when the liquid crystal display panel is a normally white mode liquid crystal display panel and the driving voltage is attenuated;

wherein when the driving voltage is attenuated, the transmittance of the of the liquid crystal display panel increases over time.

19. The liquid crystal display apparatus of claim 18, further comprising a backlight control circuit, wherein in the display frame cycle, the backlight control circuit controls the backlight driving circuit to gradually or gradiently decrease the backlight driving current, so as to make the brightness/luminance of the backlight source decrease over time.

20. The liquid crystal display apparatus of claim 18, further comprising a backlight control circuit, wherein the backlight control circuit forms a plurality of backlight shield-blocking periods in the display frame cycle, the backlight control circuit controls the backlight driving circuit to temporarily dark state in the backlight shield-blocking periods, and a backlight turn off the backlight source or temporarily turn down the backlight source to a shield-blocking persistent period of the backlight shield-blocking periods sequentially increases, to decrease the brightness/luminance of the backlight.

21. The liquid crystal display apparatus of claim 18, wherein the backlight module further comprises a display driving conversion reference table, and during the display frame cycle, the backlight module controls the backlight driving circuit according to the display driving conversion reference table, so as to compensate the effect of the transmittance or brightness/luminance decreasing over time in the cycle.

* * * * *